US005788551A

United States Patent [19]

Dynka et al.

[11] Patent Number: 5,788,551

[45] Date of Patent: Aug. 4, 1998

[54] FIELD EMISSION DISPLAY PACKAGE AND METHOD OF FABRICATION

[75] Inventors: Danny Dynka; David A. Cathey, Jr.; Larry D. Kinsman, all of Boise, Id.

[73] Assignee: Micron Technology, Inc., Boise, Id.

[21] Appl. No.: 677,725

[22] Filed: Jul. 8, 1996

Related U.S. Application Data

[63] Continuation of Ser. No. 538,498, Sep. 29, 1995, Pat. No. 5,697,825.

[51] Int. Cl.[6] ..... H01J 9/26

[52] U.S. Cl. ..... 445/25

[58] Field of Search ..... 445/24, 25, 50

[56] References Cited

U.S. PATENT DOCUMENTS

| | | | |
|---|---|---|---|
| 2,882,116 | 4/1959 | Williams | 316/19 |
| 3,330,982 | 7/1967 | Dickson, Jr. | 313/108 |
| 3,665,238 | 5/1972 | VanEsdonk et al. | 313/220 |
| 4,005,920 | 2/1977 | Wimmer | 316/19 |
| 4,018,374 | 4/1977 | Lee et al. | 228/121 |
| 4,204,721 | 5/1980 | Hubert et al. | 316/19 |
| 4,245,273 | 1/1981 | Feinberg et al. | 361/382 |
| 4,259,613 | 3/1981 | DuBois | 313/497 |
| 4,417,296 | 11/1983 | Schelhorn | 361/386 |
| 4,449,949 | 5/1984 | Eto et al. | 445/24 |
| 4,665,468 | 5/1987 | Dohya | 361/414 |
| 4,795,670 | 1/1989 | Nishigaki et al. | 438/209 |
| 5,205,770 | 4/1993 | Lowrey et al. | 445/24 |
| 5,210,462 | 5/1993 | Konishi | 313/495 |
| 5,210,472 | 5/1993 | Casper et al. | 315/349 |
| 5,229,331 | 7/1993 | Doan et al. | 437/228 |
| 5,302,238 | 4/1994 | Roe et al. | 156/643 |
| 5,507,676 | 4/1996 | Taylor et al. | 445/24 X |
| 5,519,332 | 5/1996 | Wood et al. | 324/755 |
| 5,587,622 | 12/1996 | Mohacsi | 445/25 X |

FOREIGN PATENT DOCUMENTS 3-11524 1/1991 Japan .

OTHER PUBLICATIONS

Liu, D. et al., "Characterization of Gated Silicon Field Emission Micro Triodes", Sixth International Vacuum Microelectronics Conference, IEEE, Electron Devices Society, Technical Digest, Jul., 1993, pp. 52, 53.

Leppo, Marion et al., *Electronic Materials Handbook*, vol. 1 Packaging, 1989, pp. 203–205.

Kishino, Takao et al., "Present Status of the FED Development and Problems to Solve", Technical Paper, IVMC, Futaba Corporation, Japan, 1995.

Meyer, R., "6" Diagonal Microtips Fluorescent Display for T.V. Applications", LETI/DOPT CENG, Euro display 1990, pp. 374–377.

Vaudaine, R., "'Microtips' Fluorescent Display", IEDM, 1991.

Glass Panel Alignment and Sealing for Flat Panel Displays, Sandia National Laboratory, Colorado, Program Summary, Dec. 1994.

(List continued on next page.)

*Primary Examiner*—Kenneth J. Ramsey
*Attorney, Agent, or Firm*—Stephen A. Gratton

[57] ABSTRACT

A method for evacuating and sealing a field emission display package is provided. The method includes forming a cover plate, a backplate, and a peripheral seal therebetween. The backplate is formed as a sub-assembly which includes a seal ring and a getter material. The seal ring includes compressible protrusions for initially separating the cover plate from the seal ring to provide evacuation openings. During a sealing and evacuation process the packages are placed in the reaction chamber of a furnace. The pressure in the reaction chamber is then reduced and the temperature is increased in a staged sequence. During the evacuating and sealing process the evacuation openings formed by the compressible protrusions provide a flow path for evacuation. As the sealing and evacuation process continues, the compressible protrusions and seal ring flow and commingle to form the peripheral seal. At the same time the getter material is activated and pumps contaminants from the sealed spaced formed within the package.

24 Claims, 3 Drawing Sheets

OTHER PUBLICATIONS

Zimmerman, Steven et al., Flat Panel Display Project Presentation, Sandia National Laboratories, Technical Information Exchange Workshop, Nov. 30, 1994.

Tummala, Rao R., *Microelectronics Packaging Handbook*, pp. 736–755, 1989.

Cathey, David A. Jr., "Field Emission Displays", VLSI, Taiwan, May–Jun. 1995.

FIELD EMISSION DISPLAY PACKAGE AND METHOD OF FABRICATION

CROSS REFERENCE TO RELATED APPLICATIONS

This application is a continuation of application Ser. No. 08/538,498 filed Sep. 29, 1995, U.S. Pat. No. 5,697,825.

This invention was made with Government support under Contract No. DABT63-93-C-0025 awarded by Advanced Research Projects Agency (ARPA). The Government has certain rights in this invention.

FIELD OF THE INVENTION

This invention relates generally to field emission displays and particularly to an improved process for evacuating and sealing field emission display packages.

BACKGROUND OF THE INVENTION

Flat panel displays have recently been developed for visually displaying information generated by computers and other electronic devices. These displays can be made lighter and require less power than conventional cathode ray tube displays. One type of flat panel display is known as a cold cathode field emission display (FED).

A field emission display uses electron emissions to illuminate a cathodoluminescent display screen (termed herein a "faceplate") and generate a visual image. An individual field emission pixel typically includes emitter sites formed on a baseplate. The baseplate includes the circuitry and devices that control electron emission from the emitter sites. A gate electrode structure, or grid, is associated with the emitter sites. The emitter sites and grid are electrically connected to a voltage source. The voltage source establishes a voltage differential between the emitter sites and grid and controls electron emission from the emitter sites. The emitted electrons pass through a vacuum space and strike phosphors contained on the display screen. The phosphors are excited to a higher energy level and release photons to form an image. In this system the display screen is the anode and the emitter sites are the cathode.

The emitter sites and faceplate are spaced apart by a small distance to stand off the voltage difference between them and to provide a gap for gas flow. In order to provide a uniform resolution, focus and brightness at the faceplate, it is important that this distance be uniform across the total surface of the faceplate. In addition, in order to achieve reliable display operation during electron emission from the emitter sites, a vacuum on the order of $10^{-6}$ Torr or less is required. The vacuum is formed in a sealed space contained within the field emission display.

In the past, field emission displays have been constructed as a package having a seal for sealing the space between the baseplate and faceplate. Typically, some type of a tube must also be provided for evacuating this space during construction of the field emission display package. The tube provides a conduit for pumping gases out of the sealed space to form a vacuum. After forming the vacuum, the tube must also be sealed by pinching or by affixing a sealing member such as a plug.

One problem with this type of tubulated package is that the tube is a permanent part of the assembly. The tube requires a separate sealing operation and a separate seal. Moreover, the tube represents an additional component that can potentially fail during the lifetime of the field emission display package. The protrusion of the tube from the display body is inconvenient and must be accommodated during packaging of the display into a system, such as a lap top computer.

It would be advantageous if a field emission display package could be formed without an evacuation tube. This would simplify the package and eliminate a potential source of failure. It would also be advantageous to be able to seal the field emission display package and activate a getter at the same time that the vacuum is formed. This would simplify the manufacturing process.

OBJECTS OF THE INVENTION

In view of the foregoing, it is an object of the present invention to provide an improved method for evacuating and sealing field emission displays.

It is a further object of the present invention to provide an improved non-tubulated package for field emission displays.

It is a still further object of the present invention to provide an improved method for evacuating and sealing field emission displays and an improved field emission display package that are low cost, that provide a reliable vacuum seal and that are compatible with commercial manufacturing operations.

It is a still further object of the present invention to provide an improved method for sealing a field emission display package that enables bake out, evacuation and getter activation to be achieved in a single operation.

It is another object of the present invention to provide an improved sealing technique for field emission displays and other electronic components that does not rely on metal to metal seals.

It is yet another object of the present invention to provide an improved sealing technique for field emission displays that allows backplate to faceplate alignment to be achieved at atmospheric pressure prior to sealing.

It is yet another object of the present invention to provide an improved sealing technique which can be performed using conventional thermo-vacuum process vessels.

Other objects, advantages and capabilities of the present invention will become more apparent as the description proceeds.

SUMMARY OF THE INVENTION

In accordance with the present invention, an improved method for evacuating and sealing field emission display packages and an improved field emission display package are provided. The field emission display package, generally stated, includes a backplate (first plate), a cover plate (second plate) and a getter material. Using the method of the invention the backplate and cover plate are bonded together with a peripheral seal to form an evacuated sealed space in the interior of the package. Within this sealed space components of a field emission display are mounted.

Evacuation of the sealed space, and formation of the peripheral seal, are accomplished in a reaction chamber at vacuum pressure. To form the peripheral seal, a seal ring comprising a flowable material, such as glass frit or indium, is initially applied in a peripheral pattern to the backplate (or cover plate). A seal ring formed of glass frit must also be pre-fired to a semi-crystalline state.

In addition to the seal ring, compressible protrusions are formed between the backplate and cover plate prior to the heating and evacuating process. The compressible protrusions can be formed as a part of the seal ring or as a separate component. During the evacuation and sealing process, the interior of the package is evacuated while the seal ring and compressible protrusions are compressed to form the peripheral seal.

The compressible protrusions function to initially space the cover plate from the backplate in order to provide an evacuation opening or flow path for evacuating the interior of the package. In a similar manner, the compressible protrusions can provide a reverse flow path for manipulating the composition of the gaseous atmosphere within the package. For example in some cases a background gas such as hydrogen can be placed within the sealed space using a gas backfill or gas trickle purge.

At the same time that the peripheral seal is being formed at the backplate-cover plate interface, the getter contained within the package can be activated by elevated temperatures. Thus the package can be evacuated, the getter activated, and a seal formed in the same process step from a single heat source and with no exhaust conduit. After the package is sealed, the getter functions to further decrease the pressure within the sealed package.

Prior to the evacuating and sealing process the backplate and cover plate of the display package are preassembled with a faceplate-baseplate pair for the field emission display. In addition, the seal ring and compressible protrusions are formed between the backplate and cover plate. The assembly is then placed in a reaction chamber which is evacuated and heated to evacuate and outgas the display package, activate the getter, and seal the display package.

The reaction chamber can be a quartz tube furnace or a stainless steel vessel. A weighted alignment jig aligns the plates and presses the cover plate against the seal ring during the evacuating and sealing process. Alternately the two surfaces to be sealed can be aligned and tacked to one another prior to applying the weight or clamping force required to subsequently compress the seal ring. This step can also include alignment of the backplate and cover plate using optical or mechanical alignment techniques performed at room temperature and atmospheric pressure.

For a seal ring formed of a frit material, the evacuating and sealing process is preferably carried out in stages over the course of several hours. Initially the package is placed in the reaction chamber and a high vacuum is created in the reaction chamber using vacuum pumps (e.g., $4.7\times10^{-7}$ Torr). At the same time the reaction chamber is initially maintained at a relatively low temperature that is well below the flowing point of the glass frit (e.g., 100° C.–150° C.). The package is allowed to soak at this temperature and pressure for a time period (e.g., 1–2 hours) sufficient to reach equilibrium and outgas water and other contaminants from the quartz tube and from the package via the flow path provided by the compressible protrusions. The temperature is then increased further (e.g., 210° C.–310° C.) and held for another relatively long time period to equalize the temperature, outgas contaminants and allow the internal package area and furnace to recover in vacuum. At this stage the temperature is still well below the frit flowing point (for a frit seal ring) but the getter begins to be activated.

The temperature is then increased to a temperature at which the frit outgasses a mixing agent added to make a viscous paste (e.g., 325° C.–400° C.). The package is held at this temperature for several hours and the getter becomes further activated. The temperature is then increased to above the flowing temperature of the frit material (e.g., above 400° C.). At this temperature, the compressible protrusions and frit seal ring flow under the weight of the alignment jig and form a continuous peripheral seal. In addition the getter is now more fully activated and pumps the internal package area which has now been sealed. The temperature is then ramped down over several hours further decreasing the pressure in the sealed package. The final pressure within the package can be on the order of $4.0\times10^{-7}$ Torr.

In the preferred embodiment the compressible protrusions are made of the same material as the seal ring and are placed immediately superjacent to the seal rings. This configuration simplifies the manufacturing process. However, the compressible protrusions can also be formed towards a side of the seal ring or subjacent to the seal ring. Additionally, the compressible protrusions can be formed with a different composition than the seal ring so long as it is thermochemically compressible.

In an alternate embodiment a frit seal ring and compressible protrusions are used to form a direct seal between a faceplate of the field emission display and a backplate of the package. In this case no cover plate for the package is employed. In yet another alternate embodiment the package is formed by the faceplate and baseplate of the field emission display. In this case the compressible protrusions and seal ring are used to form a direct seal from the faceplate to the baseplate and no cover plate nor backplate are employed.

DETAILED DESCRIPTION OF THE PREFERRED EMBODIMENTS

Figure 1:
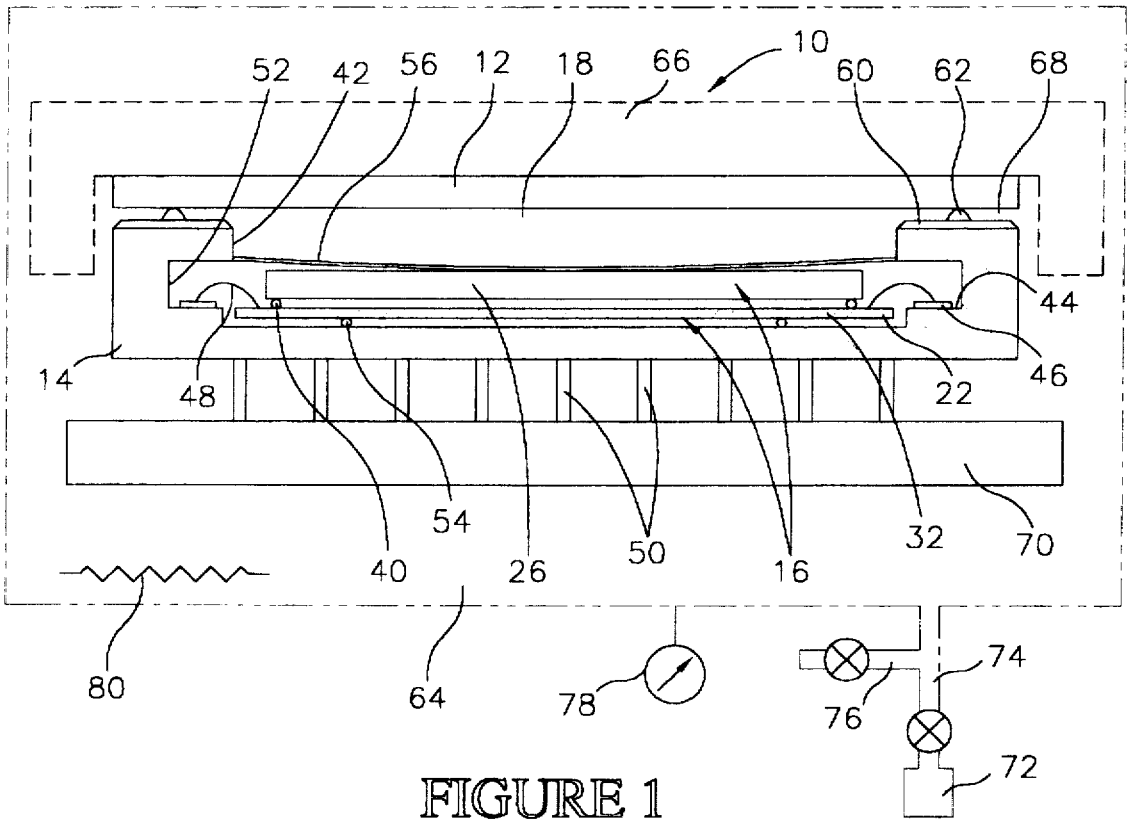
FIG. 1 is a schematic cross sectional view of a field emission display package being constructed in accordance with the method of the invention.

Referring now to FIG. 1, the method of the invention is illustrated in the fabrication of a field emission display package 10. FIG. 1 shows the field emission display package 10 during the fabrication process. The field emission display package 10 includes: a transparent cover plate 12; a backplate 14; and a field emission faceplate-baseplate pair 16 mounted to the backplate 14. The field emission faceplate-baseplate pair 16 is mounted within an evacuated sealed space 18 formed in the interior of the package 10. The field emission faceplate-baseplate pair 16 includes a baseplate 22 and a faceplate or display screen 26.

Figure 2:
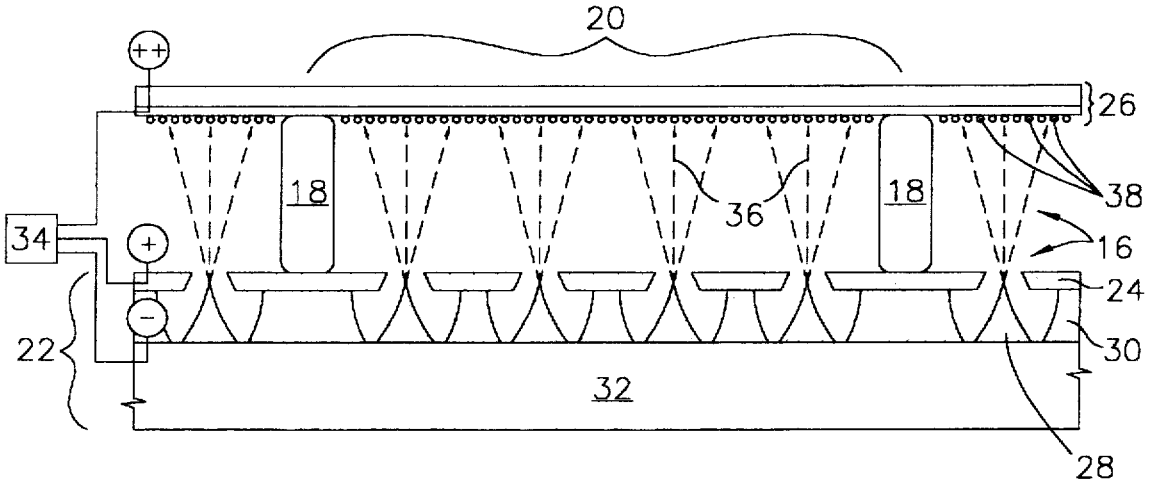
FIG. 2 is an enlarged schematic cross sectional view of a field emission display segment for the field emission display package of FIG. 1.

With reference to FIG. 2, an enlarged view of a display segment 20 of the faceplate-baseplate pair 16 is shown. Each display segment 20 is capable of displaying a pixel of an image (or a portion of a pixel). The baseplate 22 includes a substrate 32, formed of a material such as single crystal silicon, or alternately amorphous silicon deposited on a glass substrate. A plurality of field emitter sites 28 are formed superjacent to substrate 32. The grid 24 surrounds the emitter sites 28 and is electrically insulated and spaced from the substrate 32 by an insulating layer 30.

A source 34 is electrically connected to the emitter sites 28, to the grid 24 and to the display screen 26. The display screen 26 is separated from the baseplate 22 by spacers 40 (FIG. 1). When a voltage differential is applied by the source 34, a stream of electrons 36 is emitted by the emitter sites 28 towards the display screen 26. In this system the display screen 26 is the anode and the emitter sites 28 are the cathode. The electrons 36 emitted by the emitter sites 28 strike phosphors 38 of display screen 26. This excites the phosphors 38 to a higher energy level. Photons are released as the phosphors 38 return towards their original energy level.

U.S. Pat. No. 5,302,238 to Roe et al.; U.S. Pat. No. 5,210,472 to Casper et al.; U.S. Pat. No. 5,232,549 to Cathey et al.; U.S. Pat. No. 5,205,770 to Lowrey et al.; U.S. Pat. No. 5,186,670 to Doan et al.; and U.S. Pat. No. 5,229,331 to Doan et al.; all of which are incorporated by reference disclose methods for forming field emission displays.

Referring back again to FIG. 1, the backplate 14 includes a cavity 42 wherein the baseplate 22 for the faceplate-baseplate pair 16 is mounted. The baseplate 22 contains various electrical devices and circuits which control the operation of the faceplate-baseplate pair 16. The baseplate 22 is mounted within the cavity 42 on spacer rods 54 formed of a ceramic or quartz material. The spacer rods 54 separate the baseplate 22 from the backplate 14 so that a vacuum ultimately forms on either side of the baseplate 22. Mounting the baseplate 22 between the cover plate 12 and backplate 14 eliminates the need for a silicon to glass seal when a silicon baseplate is used. In addition, with this arrangement the baseplate 22 is not subjected to a differential pressure. Furthermore, this arrangement provides a rigid structure to resist deflection from the loads imposed by atmospheric pressure.

The backplate 14 also includes a bond shelf 44 wherein bonding pads 46 are mounted. The bond shelf 44 is formed in a groove 52 formed in the backplate 14. The bonding pads 46 are electrically connected to external connectors 50 formed on the outside of the backplate 14. The external connectors 50 are formed as a pin grid array (PGA) and are adapted for electrical connection to a mating socket assembly (not shown) wherein the package 10 will ultimately be mounted.

Wires 48 are wire bonded to the bonding pads 46 and to corresponding connection points (not shown) on the baseplate 22. This establishes a circuit path from the outside world through the external connectors 50, through the bonding pads 46, through the wires 48 and to the electrical circuits formed on the baseplate 22. In addition, a high voltage connection (not shown) is made between the display screen 26 and a conductive pad which feeds through the sidewall of backplate 14 outside of the sealed space 18.

Advantageously, all of the external electrical connections to the baseplate 22 are through the external connectors 50 formed in the backplate 14. In the illustrative embodiment, the backplate 14 is a multi layer block formed of a fired laminated ceramic material such as mullite. Mullite in sheets and in shapes such as backplate 14 of FIG. 1 are commercially available from Kyocera. The backplate 14 can be formed using high temperature ceramic lamination processes that are known in the art. With such a process green sheets of unsintered flexible raw ceramic are cut to size. Next, via holes and other inside features as required are punched through the green sheets. Next, the via holes are either filled or coated with a conductive material (e.g., tungsten paste) to provide an interlevel connection between the different laminated layers of the backplate 14. Next, a screen printing process is used to print a metallized pattern of conductive lines (or conductive planes) on selected green sheet surfaces. In this case, the conductive lines provide a conductive path between the external connectors 50 and the bonding pads 46. Several green sheets are formed as required then stacked in the required sequence and bonded together. The different green sheets are then sintered at elevated temperature (1500° C.–1600° C.) in a reducing atmosphere. This is followed by a plating process to form the bonding pads 46 and other conductive traces as required out of a suitable metal. The plating process can include electrolytic or electroless deposition followed by resist coating, exposure, development, and selective wet chemical etching. Next, cutting or punching operations are performed to define the peripheral dimensions of the backplate 14.

Viewed from above, the backplate 14 of the package 10 has a generally rectangular outer peripheral configuration. The cover plate 12 has a matching configuration and is formed of a transparent glass material, such as Corning 7059 glass.

Prior to the evacuating and sealing process, the backplate 14 and faceplate-baseplate pair 16 are assembled and wire bonded as a subassembly. In addition, a getter material 56 is mounted within the space 18 between the cover plate 12 and backplate 14. The getter material 56 can be formed as a strip of metal foil, such as aluminum or steel, that is coated with a getter compound. The getter compound can typically be a titanium based alloy that functions to trap and react with gaseous molecules. Metallic particulates deposited on a metal foil which become reactive when heated are commercially available. One suitable product is marketed by SAES and designated a type ST-707 getter strip. The getter material 56 functions to decrease the pressure within the sealed space 18 during the sealing and evacuation process and throughout the lifetime of the display package 10.

The getter material 56 is shaped as a curved spring member and serves the dual function of retaining the faceplate-baseplate pair 16 within the cavity 42 of the backplate 14. As such, the getter material 56 is mounted to a lip (not shown) formed in the backplate 14 and is adapted to press against the display screen 26 of the field emission display. The getter material 56 can formed as two relatively thin strips of material (e.g., ⅛ inch) mounted along the outer edges of the display screen 26. In the illustrative embodiment, a high voltage connection to the display screen 26 can be formed by a spring member similar in shape to the getter material 56.

During the evacuating and sealing process, a peripheral seal 58 (FIG. 3C) is formed on an inside surface of the cover plate 12 and on an inside surface of the backplate 14. At the same time the sealed space 18 is formed and evacuated and the getter material 56 is activated. The cover plate 12, backplate 14, and peripheral seal 58 form the sealed space 18. The peripheral seal 58 viewed from above has a generally rectangular shaped peripheral configuration.

In the illustrative embodiment, the peripheral seal 58 is formed by applying a frit paste on the inside surface of the backplate 14 and then pre-firing the paste to form a frit seal ring 60. By way of example a viscous frit paste can be applied and then pre-fired to a temperature of 200° C. to 400° C. The object of the pre-firing step is to heat the frit seal ring 60 to a temperature wherein the frit material is in a semi-crystalline or partially hardened state. In general this is a temperature just below that wherein prenucleation of the frit will begin to occur.

The frit seal ring 60 can be formed of a glass frit material such as LS-0104 which is commercially available from Nippon Electric Glass America, Inc. The glass frit material can be either a vitreous frit or a devitrifying frit. As used herein, the term vitrify, vitrification and firing refer to the process of converting a siliceous material into an amorphous glassy form by melting or flowing followed by cooling. Preferably the glass frit material for the frit seal ring 60 has a coefficient of thermal expansion that closely matches that of the cover plate 12 and backplate 14. The frit seal ring 60 can be applied as a viscous paste using a suitable stencil (not shown) or applied as a bead from a dispense nozzle. The paste can be formed by combining the glass frit material with a solvent such as pine oil.

The frit seal ring 60 also includes protrusions that are termed herein as compressible protrusions 62. The compressible protrusions 62 are formed at the peripheral corners of the generally rectangular shaped frit seal ring 60. The compressible protrusions 62 are areas of increased height, or thickness, and are preferably formed of a same material as the remainder of the frit seal ring 60. The compressible protrusions 62 are adapted to initially separate the cover plate 12 from the frit seal ring 60 and provide a flow path during the evacuating and sealing process.

For the frit seal ring 60 the evacuating and sealing process is carried out in a heated reaction chamber 64 in a vacuum atmosphere. By way of example, the reaction chamber 64 can be within a quartz lined tube similar to that of a diffusion furnace used in semiconductor fabrication. In general, diffusion furnaces are used to diffuse dopants into a semiconducting substrate at high temperatures and reduced pressures. A low pressure chemical vapor deposition (LPCVD) furnace can also be used. Such a LPCVD furnace is also used in semiconductor fabrication to deposit various materials at high temperatures and reduced pressures. These types of furnaces can be heated to temperatures greater than the temperature required for flowing the glass frit material (e.g., 100° C. to 600° C.). In addition, these types of furnaces can be evacuated using suitable pumps to a pressure of less than $10^{-7}$ Torr. The reaction chamber 64 can also be formed as a stainless steel vessel.

As shown in FIG. 1, the reaction chamber 64 is in flow communication with a valved conduit 74 and a vacuum pump 72. A valved purge line 76 allows various gases to be purged from the reaction chamber 64. A pressure gauge 78 measures the pressure within the reaction chamber 64. In addition a heating source 80 is operatively associated with the reaction chamber 64 for heating the chamber to elevated temperatures.

A quartz workholder 70 is used to support the package 10 within the reaction chamber 64. In addition, a weighted alignment jig 66 can be placed on the cover plate 12 to provide the mechanical force (F) necessary in forming the peripheral seal 58. In addition, the alignment jig 66 is adapted to maintain the alignment of the cover plate 12 with respect to the backplate 14. Alternately the cover plate 12 and backplate 14 can be aligned to one another prior to applying the force required to compress the frit seal ring 60 and compressible protrusions 62.

Figure 3A:
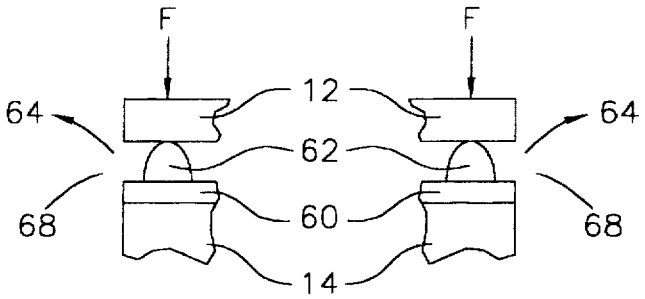
FIGS. 3A–3C are schematic side views with parts removed illustrating seal formation during an evacuating and sealing process of the invention.
Figure 3B:
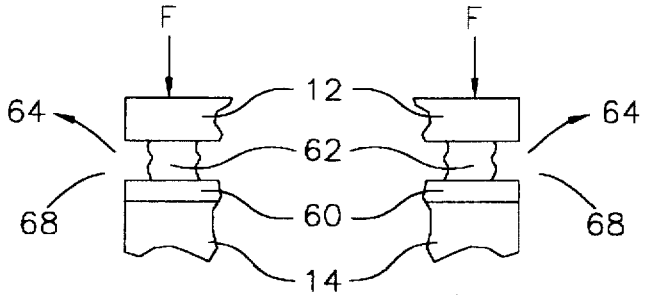
Figure 3C:
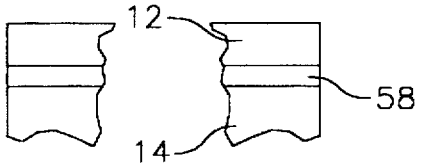

The evacuating and sealing process is shown schematically in FIGS. 3A–3C. Initially, as shown in FIG. 3A, the frit seal ring 60 and compressible protrusions 62 are in a semi-crystalline or partially hardened state. At this stage of the process the compressible protrusions 62 support the cover plate 12 so that evacuation openings 68 are formed therebetween. The evacuation openings 68 extend across the length and width of the rectangular shaped frit seal ring 60. In addition, the evacuation openings have a height "H" determined by the height of the compressible protrusions 62. By way of example and not limitation, the compressible protrusions have a height "H" which is on the order of about 0.01 inches. A spacing between the compressible protrusions 62 is dependent on the overall dimensions (i.e., length and width) of the field emission display 10. By way of example and not limitation, this spacing is on the order of approximately 1 inch.

The cover plate 12 and backplate 14 are placed in the reaction chamber 64 of the furnace with the frit seal ring 62 initially configured as shown in FIG. 3A to form evacuation openings 68 and a flow path for evacuation. The evacuating and sealing process is then initiated for evacuating the package 10 and heating the frit seal ring 60 and compressible protrusions 62 to form the peripheral seal 58.

Once the cover plate 12 and the backplate 14 are placed in the reaction chamber 64, the reaction chamber 64 is evacuated from atmospheric pressure to a negative pressure which is on the order of $10^{-7}$ atmospheres or less. The temperature in the reaction chamber 64 is increased from ambient to a temperature sufficient to flow the frit seal ring 60 and compressible protrusions 62 to form the peripheral seal 58.

The evacuating and sealing process is preferably accomplished in stages wherein the reaction chamber 64 is initially pumped out to a negative pressure and then gradually ramped up to a predetermined temperature. The controls for the furnace are configured to achieve a predetermined temperature and pressure within the reaction chamber 64.

Initially the evacuation openings 68 formed by the compressible protrusions 62 allow a flow path for evacuating the interior of the field emission display package 10. As the evacuating and sealing process continues, however, and as shown in FIG. 3B, the evacuation openings 68 begin to close as the frit seal ring 60 and compressible protrusions 62 soften and come together.

At the completion of the evacuating and sealing process, and as shown in FIG. 3C, the frit seal ring 60 and compressible protrusions 62 have melted and commingled to form the peripheral seal 58. At this point, the evacuation opening 68 has been completely sealed. The getter material 56 has also been activated by the elevated temperatures and continues pumping gas and vapors from the sealed space 18.

Alternately instead of forming the seal ring out of a frit material a substantially equivalent seal ring can be formed of indium. In this embodiment the indium can be applied in a preformed shape such as an enclosed loop of indium wire. Alternately a solder technique or a mechanical technique using a spatula or other tool can be used to form a seal ring out of indium. In addition, a seal ring formed of indium need not be subsequently heated as a seal can be formed simply using compression. However, in this embodiment a subsequent heating step may be required to activate the getter.

EXAMPLE

Figure 4:
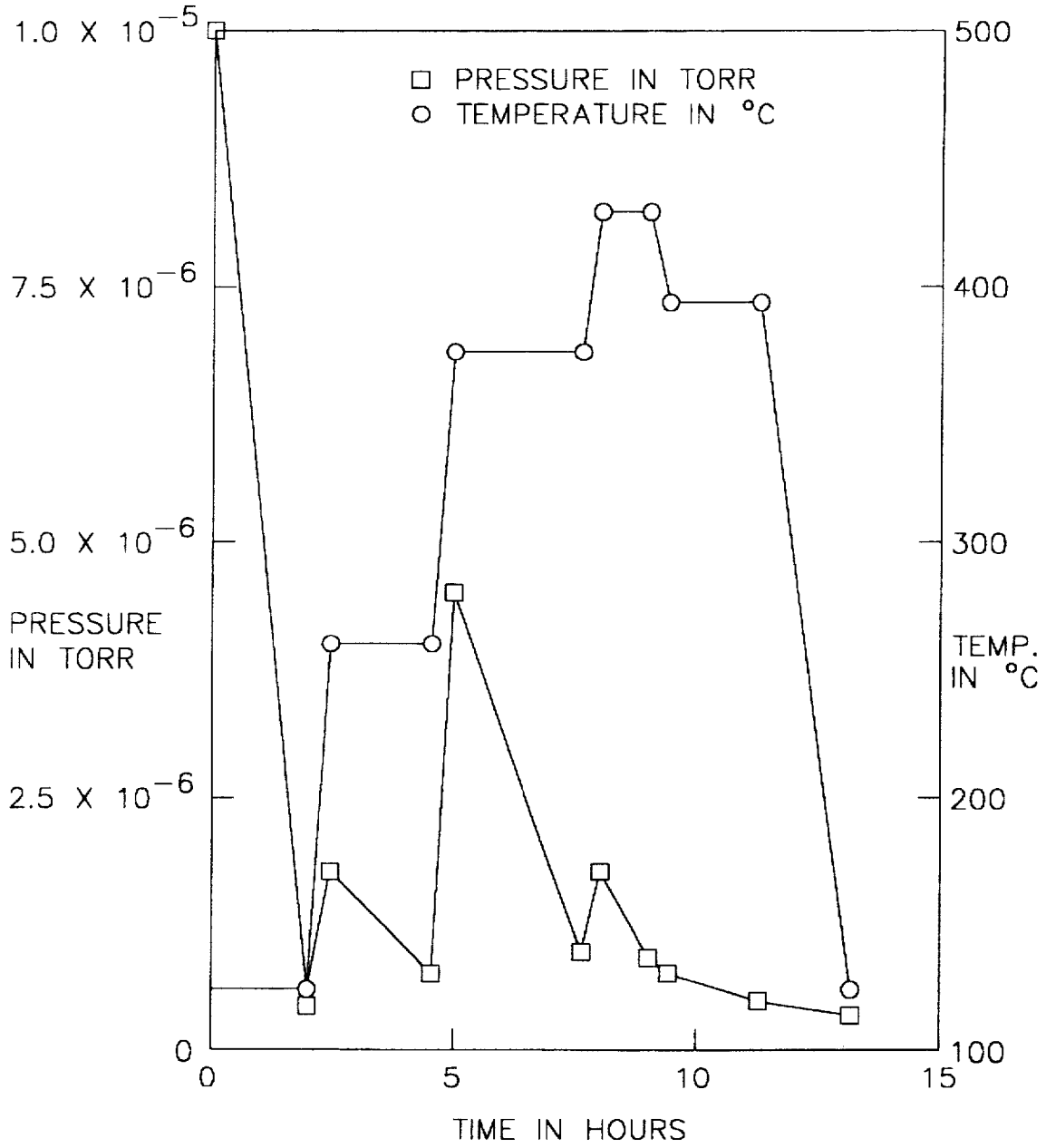
FIG. 4 is a graph that plots the pressure in Torr within the reaction chamber and the temperature in °C. versus time in hours during the evacuating, sealing and getter activation process of the invention.

The following example is for a seal ring and compressible protrusions formed of a frit material. The evacuating and sealing process is preferably carried out in stages wherein the temperature is ramped up and then held for several hours. FIG. 4 shows such a ramped process. In addition, Table 1 lists the parameters of process time, dwell time, step type, temperature and pressure for an illustrative process.

TABLE 1

| PROCESS TIME IN HOURS | DWELL IN HOURS | STEP TYPE | TEMP IN °C. | PRESSURE IN REACTION CHAMBER IN TORR |
|---|---|---|---|---|
| 0 | 0 | START PROGRAM | 125 | $1.0 \times 10^{-5}$ |
| 2 | 2 | SOAK AT TEMP | 125 | $4.7 \times 10^{-7}$ |
| 2.5 | 0.5 | RAMP TO TEMP | 260 | $1.8 \times 10^{-6}$ |
| 4.5 | 2 | SOAK AT TEMP | 260 | $7.5 \times 10^{-7}$ |
| 5 | 0.5 | RAMP TO TEMP | 375 | $4.5 \times 10^{-6}$ |
| 8 | 3 | SOAK AT TEMP | 375 | $1.0 \times 10^{-6}$ |
| 8.25 | 0.25 | RAMP TO TEMP | 425 | $1.8 \times 10^{-6}$ |
| 9.25 | 1 | SOAK AT TEMP | 425 | $9.5 \times 10^{-7}$ |
| 9.5 | 0.25 | RAMP TO TEMP | 395 | $7.5 \times 10^{-7}$ |
| 11.5 | 2 | SOAK AT TEMP | 395 | $5.0 \times 10^{-7}$ |
| 13.5 | 2 | RAMP TO TEMP | 125 | $4.0 \times 10^{-7}$ |
| 13.5 | 2 | END PROGRAM | 125 | $4.0 \times 10^{-7}$ |

A brief synopsis of this process is as follows. Initially the reaction chamber 64 is idling at a temperature of 125° C. The reaction chamber 64 is opened to atmosphere after being vented up from vacuum. The packages 10 are loaded into the reaction chamber 64 and the chamber is evacuated to a pressure on the order of $4.7\times10^{-7}$. The packages 10 soak at a temperature of 125° C. for two hours while the packages 10 and the reaction chamber 64 outgas and reach equilibrium. The primary component of outgassing during this period is water.

The temperature is then incremented over a half hour to 375° C., followed by a three hour soak. This allows the mixing agents, such as pine oil, added to form the frit seal ring 60 and compressible protrusions 62 as a viscous paste to thoroughly outgas. In addition, the packages 10 and reaction chamber 64 are allowed to equalize in temperature and the internal package area and reaction chamber recover in vacuum. At this time the getter material 56 is becoming activated.

The temperature is then raised to 425° C. and maintained for one hour. This is the temperature at which the compressible protrusions 62 and frit seal ring 60 will begin to soften and flow. In addition, the compressible protrusions 62 and frit seal ring 60 will extrude or flow due to the force (F) exerted by the weighted alignment jig 66. The getter material 56 is more thoroughly activated at this elevated temperature and continues pumping of the package as the sealed space 18 is formed.

The temperature is then decreased to 395° C. and kept constant for two hours. This allows the getter material 56 to efficiently remove gas and vapors from the sealed space 18. The temperature is then decreased to 125° C. and held for about two hours. The reaction chamber 64 is vented to atmosphere and the packages 10 are removed from the reaction chamber 64.

The method of the invention allows the field emission display packages 10 to be formed without an evacuation tube because evacuation and seal formation proceed at essentially the same time.

Figure 1A:
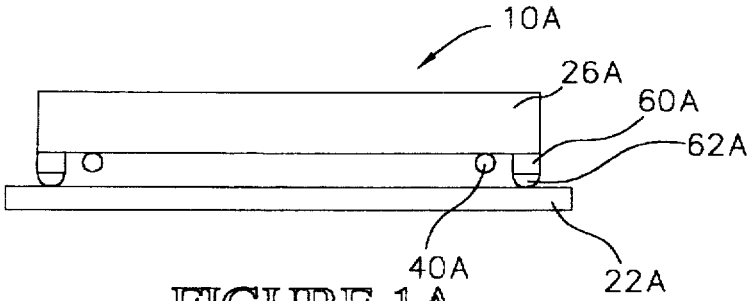
FIG. 1A is a schematic cross sectional view of an alternate embodiment field emission display package wherein no cover plate is employed and a direct seal is formed between the faceplate and backplate.
Figure 1B:
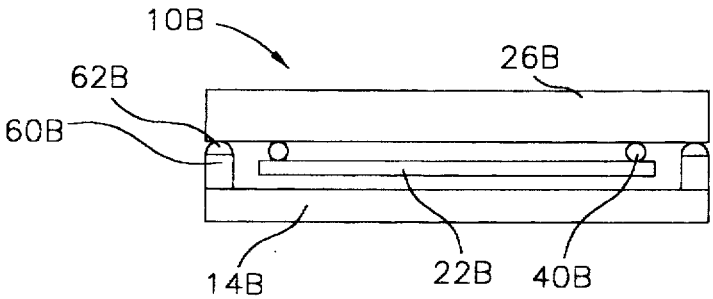
FIG. 1B is a schematic cross sectional view of another alternate embodiment field emission display package wherein neither a cover plate or a backplate are employed and a direct seal is formed between the faceplate and baseplate.

Referring now to FIGS. 1A and 1B, two alternate embodiments of the invention are shown. In FIG. 1A, a field emission package 10A includes a baseplate 22A and a faceplate 26A equivalent to the components previously described. In this embodiment, however there is no cover plate 12 and backplate 14. The frit seal ring 60A and compressible protrusions 62A are used to form a direct seal between the baseplate 22A and faceplate 26A substantially as previously described.

In FIG. 1B, a field emission package 10B includes a backplate 14B equivalent to the backplate previously described but no cover plate. The frit seal ring 60B and compressible protrusions 62B are used to form a direct seal between the backplate 14B and faceplate 26B.

While the invention has been described with reference to certain preferred embodiments, as will be apparent to those skilled in the art, certain changes and modifications can be made without departing from the scope of the invention as defined by the following claims.

What is claimed is:

1. A method for fabricating a field emission display package comprising:

providing a first plate and a second plate;

forming a seal ring on the first plate, the seal ring comprising at least one raised portion, the raised portion comprising a same material as a remainder of the seal ring;

aligning the first plate to the second plate;

tacking the first and second plates together with the seal ring and the first and second plates at least partially defining a space therebetween, and with the raised portion forming an opening to the space;

evacuating the space using a flow path provided by the opening; and heating the raised portion and the seal ring to close the opening and form a seal configured to seal the space.

2. The method as claimed in claim 1 wherein the material comprises glass frit and further comprising pre firing the glass frit to a semi crystalline state prior to the tacking step.

3. The method as claimed in claim 1 wherein the seal ring comprises a glass frit in a semi crystalline state configured to tack the first plate to the second plate.

4. The method as claimed in claim 1 further comprising placing a getter within the space and activating the getter during the heating step.

5. A method for fabricating a field emission display package comprising:

providing a first plate and a second plate;

forming a seal ring on the first plate, the seal ring comprising a glass frit having at least one raised portion;

heating the seal ring to place the glass frit in a semi crystalline state;

aligning the first plate to the second plate;

tacking the first and second plates together by placing the second plate on the raised portion with the seal ring and the first and second plates at least partially defining a space therebetween, and with the raised portion forming an opening to the space;

evacuating the space using a flow path provided the opening; and compressing the seal material to seal the space.

6. The method as claimed in claim 5 wherein the raised portion comprises an area of increased thickness of the seal ring.

7. A method for fabricating a field emission display package comprising:

providing a first plate and a second plate;

mounting field emission display components to the first plate or to the second plate, the components including a getter material;

depositing a seal ring on the first plate to at least partially define a space between the first plate and the second plate;

forming at least one raised member proximate to the seal ring;

placing the second plate on the raised member and tacking the first plate to the second plate, with the raised member separating the second plate from the seal ring to provide a flow path into the space;

evacuating the space using the flow path; and heating the seal ring, raised member, and getter material to a temperature sufficient to activate the getter material and to melt the raised member and seal ring to form a continuous peripheral seal configured to seal the space.

8. The method as claimed in claim 7 further comprising compressing the raised member and the seal ring during the heating step.

9. The method as claimed in claim 7 wherein the seal ring and raised member comprise a same glass frit material.

10. The method as claimed in claim 7 wherein the seal ring and raised member comprise a same glass frit material in a semi crystalline state.

11. A method for fabricating a field emission display package comprising:

providing a first plate and a second plate;

mounting field emission display components to the first or second plates;

applying a seal ring to the first plate, the seal ring comprising a glass frit material having at least one raised portion formed therein;

pre firing the glass frit to a partially hardened state;

aligning the first plate with the second plate;

placing the second plate and the seal ring in contact to tack the first and second plate together, with the raised portion forming an opening between the second plate and the seal ring;

placing the first and second plates in a vacuum chamber;

evacuating an area between the plates and seal ring using a flow path through the opening to the vacuum chamber; and heating and compressing the seal ring during the evacuating step to seal the area.

12. The method as claimed in claim 11 wherein the components include a getter and further comprising activating the getter during the heating and compressing step.

13. The method as claimed in claim 11 wherein the placing the second plate and the seal ring in contact step is performed at about room temperature and about atmospheric pressure.

14. The method as claimed in claim 11 wherein the heating and compressing steps is performed with a weighted alignment jig.

15. A method for fabricating a field emission display package:

providing a first plate and a second plate;

mounting field emission display components to the first plate or to the second plate;

forming a seal ring on the first plate, the seal ring comprising a glass frit material, the seal ring including at least one raised portion;

heating the glass frit material to a temperature between about 200° C. to 400° C.;

tacking the first plate to the second plate by placing the second plate on the raised portion to form a space within the seal ring and an opening between the seal ring and second plate;

evacuating the space; and heating the glass frit material during the evacuating step to a temperature above 400° C. to melt the seal ring and form a seal for sealing the space.

16. The method as claimed in claim 15 further comprising compressing the seal ring during the evacuating step.

17. The method as claimed in claim 15 wherein the tacking step is performed at about room temperature and atmospheric pressure.

18. The method as claimed in claim 15 and further comprising placing a getter within the space and activating the getter during the heating to above 400° C. step.

19. A method for fabricating a field emission display package comprising:

providing a first plate and a second plate with field emission display components thereon, the components including a getter material;

forming a seal ring having at least one raised portion on the first plate, the seal ring comprising a glass frit material;

heating the seal ring to a first temperature sufficient to place the glass frit material in a semi crystalline condition;

aligning the first plate with the second plate;

following heating to the first temperature, tacking the first plate to the second plate by placing the second plate on the raised portion such that the seal ring forms a space, and the raised portion separates the second plate from a remainder of the seal ring and provides a flow path to the space;

following the tacking step, placing the first and second plates within a vacuum process chamber and evacuating the space using the flow path; and following the placing step, heating the process chamber to a second temperature sufficient to melt the seal ring, activate the getter and form a continuous peripheral seal.

20. The method as claimed in claim 19 wherein the first temperature is between about 200° C. to 400° C.

21. The method as claimed in claim 19 wherein the second temperature is between about 100° C. to 600° C.

22. A field emission display package comprising:

a first plate;

a second plate aligned and attached to the first plate;

a plurality of field emission display components mounted to the first and second plates, the components including a getter material; and a seal ring formed between the first and second plates and at least partially defining a space therebetween, the seal ring comprising a glass frit material in a semi crystalline state, the seal ring including a raised portion configured to provide a flow path for evacuating the space.

23. The package as claimed in claim 22 wherein the raised portion comprises a plurality of protrusions.

24. The package as claimed in claim 22 wherein the first plate comprises a baseplate and the second plate comprise a faceplate.

* * * * *